US006165357A

United States Patent [19]

Cormier

[11] Patent Number: 6,165,357

[45] Date of Patent: Dec. 26, 2000

[54] ROOF DRAIN COVER

[76] Inventor: Jacques Cormier, 3290 Calixte, Laval, P.Q., Canada, H7P 4G3

[21] Appl. No.: 09/492,122

[22] Filed: Jan. 27, 2000

Related U.S. Application Data

[60] Provisional application No. 60/117,590, Jan. 27, 1999.

[51] Int. Cl.[7] ..... E04D 13/04

[52] U.S. Cl. ..... 210/163; 210/232; 210/463; 52/12; 52/302.1

[58] Field of Search ..... 210/163, 164, 210/166, 232, 460, 463; 52/12, 15, 302.1

[56] References Cited

U.S. PATENT DOCUMENTS

| | | | |
|---|---|---|---|
| 864,884 | 9/1907 | Capaldi | 210/463 |
| 926,704 | 6/1909 | Levy | 210/463 |
| 1,653,403 | 12/1927 | McCue | 210/463 |
| 2,928,419 | 3/1960 | Kruse | 210/163 |
| 4,035,297 | 7/1977 | Aldridge et al. | 210/163 |
| 4,487,690 | 12/1984 | Logsdon . | |
| 4,505,814 | 3/1985 | Marshall . | |
| 4,961,848 | 10/1990 | Logsdon . | |
| 5,141,633 | 8/1992 | Walczak et al. | 210/232 |
| 5,234,582 | 8/1993 | Savoie . | |
| 5,469,670 | 11/1995 | Thaler . | |
| 5,526,613 | 6/1996 | Simeone, Jr. . | |
| 5,618,416 | 4/1997 | Haefner . | |
| 5,650,005 | 7/1997 | Sewell | 210/163 |
| 5,724,777 | 3/1998 | Hubbard . | |

FOREIGN PATENT DOCUMENTS

| | | |
|---|---|---|
| 266480 | 1/1964 | Australia . |
| 623464 | 5/1949 | United Kingdom . |

*Primary Examiner*—Christopher Upton

[57] ABSTRACT

The roof drain cover of the present invention comprises a dome-shaped strainer adapted to sit over a roof drain pipe, a bolt going through the strainer at the center thereof, protruding from the same to downwardly extend within the pipe and having a bolt head accessible from above the strainer and abutting the same, an anchor and a disc-like stop. The anchor includes a nut screwed on the bolt, a pair of wings pivoted on the nut and foldable along the bolt and towards the strainer against the bias of a spring carried by the nut. The tips of the wings are adapted to frictionally engage the inner face of the pipe under the bias of the spring to prevent rotation of the nut when the bolt is screwed within the strainer. The disc-like stop is secured to the bolt above the nut and engages the wings to cause firm anchoring engagement of the wing tips with the pipe when the stop approaches the nut during screwing of the bolt.

5 Claims, 3 Drawing Sheets

ROOF DRAIN COVER

This application claims the benefit of U.S. Provisional Application No. 60/117,590, filed Jan. 27, 1999.

FIELD OF THE INVENTION

The present invention relates to a system for anchoring a roof drain strainer in position sitting over a roof drain pipe.

BACKGROUND OF THE INVENTION

Many roof drain covers are used to retain undesirable large debris such as leaves or the like from going into the drain pipe and possibly blocking the same by forming an obstruction wall while allowing for rain water for passing therethrough to be drained. Most of these covers are either simply inserted into the drain pipe opening without being really secured thereto or removably secured thereto. The secured covers generally require a collar or adapter that is itself secured to the drain pipe opening; such as in U.S. Pat. Nos. 4,487,690 and 4,961,848 to Logsdon, U.S. Pat. No. 4,505,814 to Marshall, U.S. Pat. No. 5,526,613 to Simeone, Jr., U.S. Pat. No. 5,618,416 to Haefner and U.S. Pat. No. 5,724,777 to Hubbard. Other roof drain covers such as in U.S. Pat. No. 5,234,582 to Savoie are provided with legs (30, 32, 52 and 54) that frictionally engage the inside surface of the drain pipe (14) under a force exerted by a screw (42, 44). A plurality of these screws are required added to the fact that they are located in close proximity of the roof surface which is not always convenient, especially when the roof drain is recessed from that roof surface.

OBJECTS OF THE INVENTION

The general object of the present invention is to provide a roof drain cover that obviates the above noted disadvantages.

Another object of the present invention is to provide a roof drain cover that is of simple, inexpensive and yet long-lasting construction and can easily be installed and removed.

A further object of the present invention is to provide a roof drain cover that is adapted to be installed in roof-drain pipe of different opening diameters.

SUMMARY OF THE INVENTION

The roof drain cover of the present invention comprises a dome-shaped strainer adapted to sit over a roof drain pipe, a bolt going through said strainer at the centre thereof, protruding from the same to downwardly extend within said pipe and having a bolt head accessible from above said strainer and abutting the same, an anchor including a nut screwed on said bolt, a pair of wings pivoted on said nut and foldable along said bolt and towards said strainer against the bias of a spring carried by said nut, the tips of said wings being adapted to frictionally engage the inner face of said pipe under the bias of said spring to prevent rotation of said nut when said bolt is screwed within said strainer, and a disc-like stop secured to said bolt above said nut, engaging said wings and causing firm anchoring engagement of said wing tips with the pipe when said stop approaches said nut during screwing of said bolt.

Preferably, the cover further includes a strip located in said strainer, secured to said side wall under said top wall, said bolt going through said strip and having a bolt head located between said top wall and said strip and abutting the latter. Preferably, the strip extends diametrically across said strainer.

Preferably, the cover further includes a cap covering each of said wing tips, said caps being adapted to frictionally engage the inner face of said pipe under the bias of said spring to prevent rotation of said nut when said bolt is screwed within said strainer.

BRIEF DESCRIPTION OF THE DRAWINGS

In the annexed drawings, like reference characters indicate like elements throughout.

DETAILED DESCRIPTION OF THE PREFERRED EMBODIMENT

Figure 1:
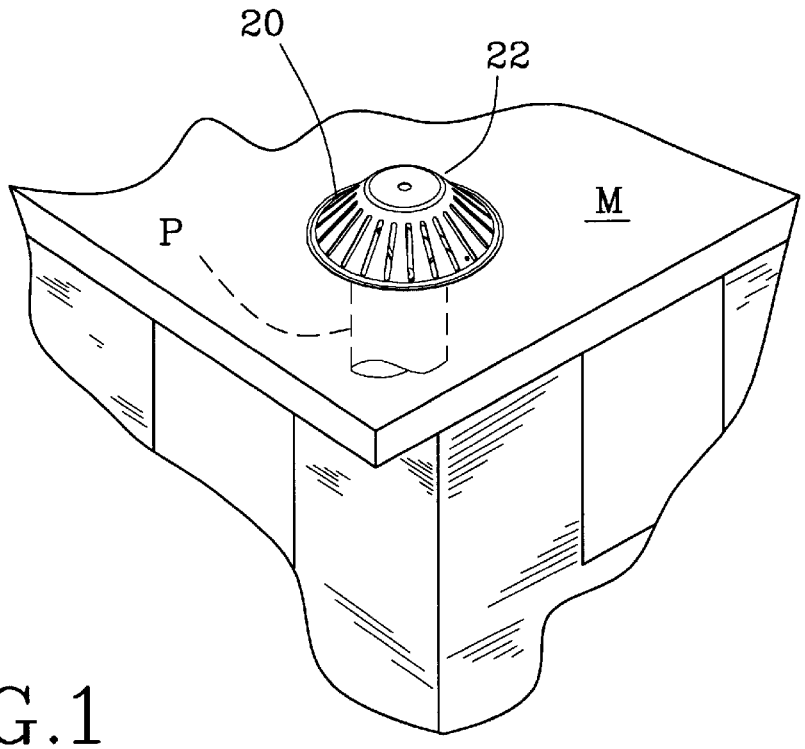
FIG. 1 is a perspective section view of an embodiment of the strainer of the present invention installed on the roof drain pipe opening.
Figure 2:
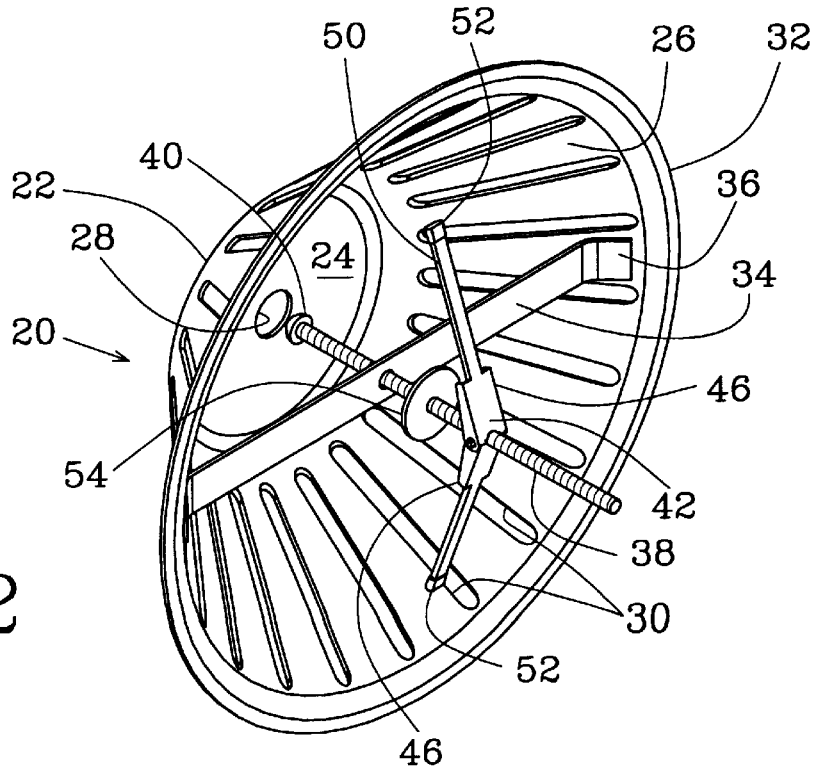
FIG. 2 is bottom perspective view of the embodiment of FIG. 1.
Figure 3:
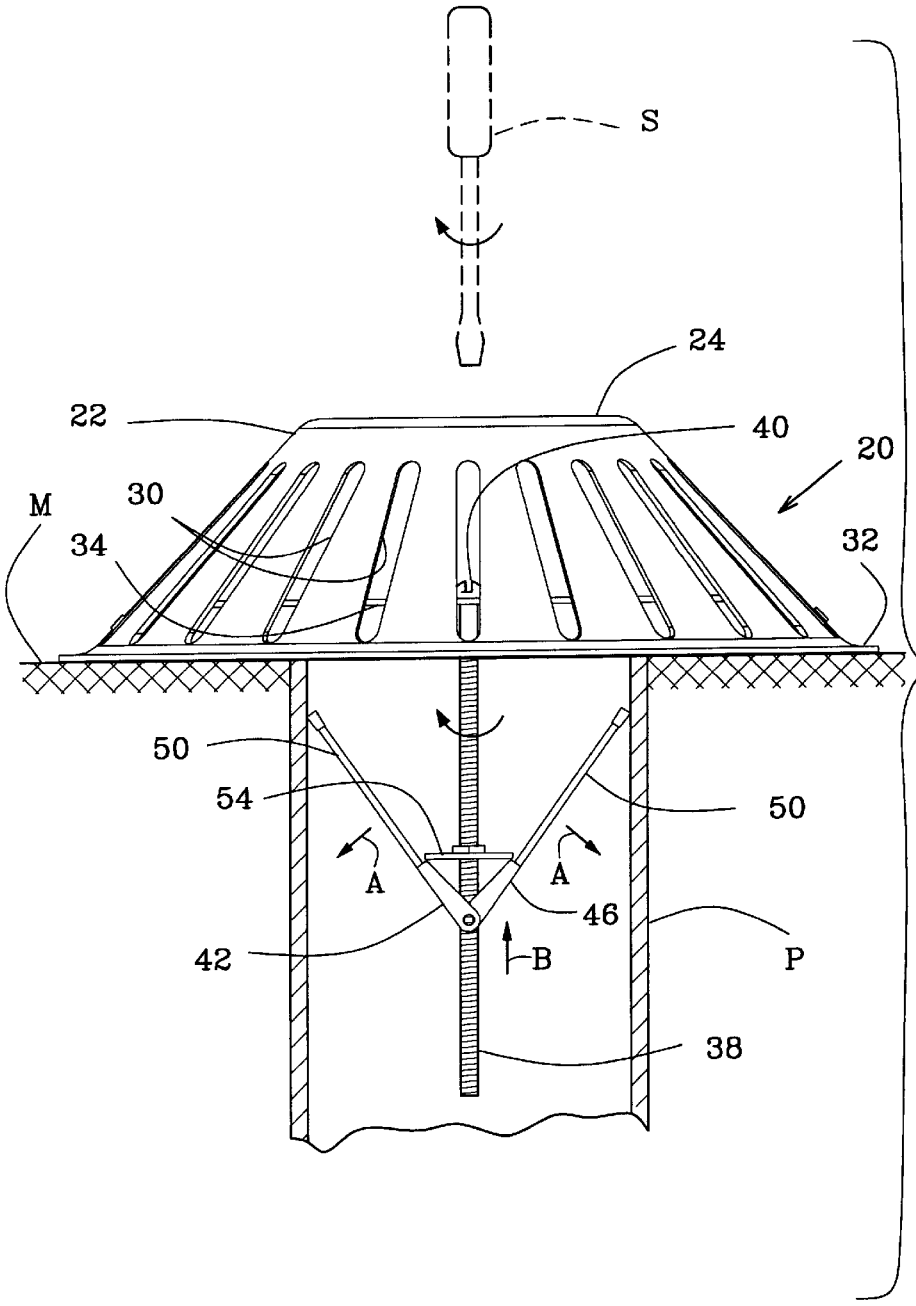
FIG. 3 is a vertical view of the embodiment of FIG. 1.
Figure 4:
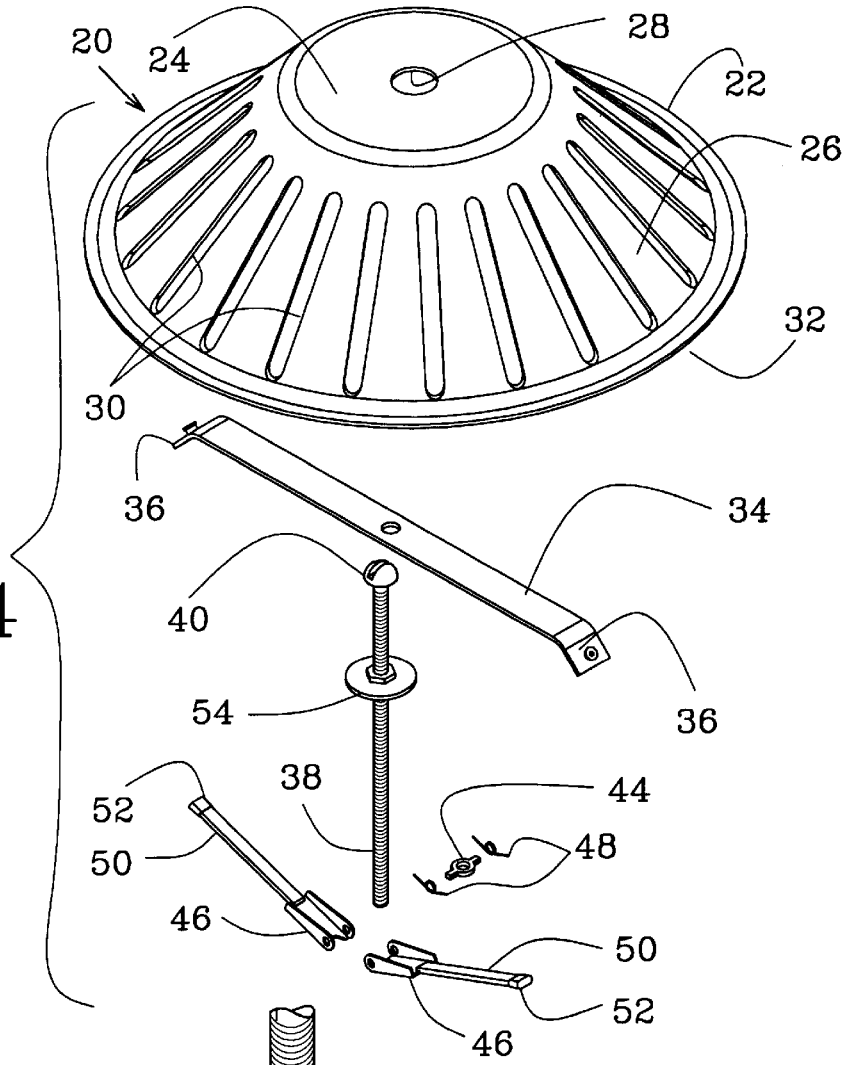
FIG. 4 is an exploded top perspective view of the embodiment of FIG. 1.
Figure 5:
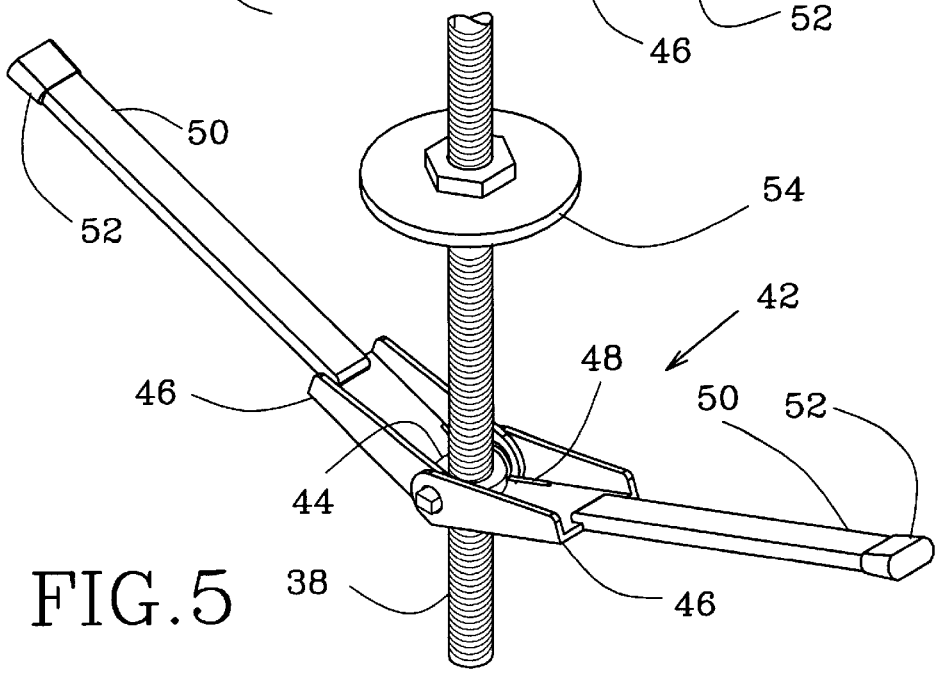
FIG. 5 is an enlarged perspective view of the section wing of the embodiment of FIG. 1.

As shown in FIGS. 1 and 2, the roof drain cover 20 of the invention is of a dome-shaped strainer 22 that has as a top wall 24 and a downwardly flaring side wall 26. The top wall 24 has a central hole 28. Side walls 26 are provided with the usual draining slots 30; the lower edge 32 of strainer 22 is adapted to sit over the roof membrane M in register with a drain pipe P. A cross-strip 34 extends diametrically across the strainer 22 with its outer ends 36 secured to the side wall 26. A bolt 38 downwardly extends centrally of the strainer 22 and goes through strip 34. The bolt head 40 of bolt 38 abuts the strip 34 and is accessible through central hole 28. A spring wing 42 is carried by bolt 28, more specifically the nut 44 of spring wing 42 is screwed on the bolt 38 below strip 34 and wings 46 are pivoted to the nut 44 for foldable movement towards bolt 38 against the bias of a spring 48 carried by the nut 44 (see FIGS. 4 and 5). As shown in FIG. 3, the wing tips 50 are preferably covered with rubber caps 52 adapted to frictionally engage the inner surface of the pipe P sufficiently to prevent rotation of spring wing 42 when bolt 38 is rotated. Arrows A indicate the action of the spring 48 on wings 46. A disc-shaped stop 54 is fixed to bolt 38 just above nut 44 and presses down the tip 50 of the wings 46 and its cap 52 when bolt 38 is screwed, with its head 40 abutting the strip 34, by a screwdriver S inserted through central hole 28 and engaging bolt head 40. The stop 54 forces wings 46 and their caps 52 into positive engagement with the pipe P in accordance with arrows B & A. Bolt 38 with spring wing 42 constitute an anchor for strainer 22. To remove strainer 22, bolt 38 is completely unscrewed from spring wing 42 and the latter is withdrawn from pipe after removal of strainer 22.

Preferably, to have a long-lastirg construction characteristic, the dome-shaped cover and the cross-strip of the strainer are made out of corrosion free material such as stainless steel, aluminum or proper thermoplastic.

Although an embodiment has been described herein with some particularity and details, many modifications and variations of the preferred embodiment are possible without deviating from the scope of the present invention.

I claim:

1. A roof drain cover comprising a dome-shaped strainer adapted to sit over a roof drain pipe, a bolt going through said strainer at the centre thereof, protruding from the same to downwardly extend within said pipe and having a bolt head accessible from above said strainer and abutting the same, an anchor including a nut screwed on said bolt, a pair of wings pivoted on said nut and foldable along said bolt and towards said strainer against the bias of a spring carried by said nut, the tips of said wings being adapted to frictionally engage the inner face of said pipe under the bias of said spring to prevent rotation of said nut when said bolt is screwed within said strainer, and a disc-like stop secured to said bolt above said nut, engaging said wings and causing firm anchoring engagement of said wing tips with the pipe when said stop approaches said nut during screwing of said bolt.

2. A roof drain cover as defined in claim 1, further including a strip located in said strainer, secured to said side wall under said top wall, said bolt going through said strip and having a bolt head located between said top wall and said strip and abutting the latter.

3. A roof drain cover as defined in claim 2, wherein said strip extends diametrically across said strainer.

4. A roof drain cover as defined in claim 2, further including a cap covering each of said wing tips, said caps being adapted to frictionally engage the inner face of said pipe under the bias of said spring to prevent rotation of said nut when said bolt is screwed within said strip.

5. A roof drain cover as defined in claim 1, further including a cap covering each of said wing tips, said caps being adapted to frictionally engage the inner face of said pipe under the bias of said spring to prevent rotation of said nut when said bolt is screwed within said strainer.

* * * * *